United States Patent [19]

Lindner

[11] 4,222,430

[45] Sep. 16, 1980

[54] METHOD OF ARMO-COATING VALVE SEATS OF INTERNAL COMBUSTION ENGINES

[75] Inventor: Horst Lindner, Königsbrunn, Fed. Rep. of Germany

[73] Assignee: Maschinenfabrik Augsburg-Nurnberg Aktiengesellschaft, Augsburg, Fed. Rep. of Germany

[21] Appl. No.: 17,045

[22] Filed: Mar. 2, 1979

[30] Foreign Application Priority Data

Mar. 4, 1978 [DE] Fed. Rep. of Germany ..... 2809384

[51] Int. Cl.[3] ..... B22D 19/02; B22D 19/08

[52] U.S. Cl. ..... 164/61; 164/80; 164/112

[58] Field of Search ..... 164/61, 80, 92, 98, 164/111, 112

[56] References Cited

U.S. PATENT DOCUMENTS

| | | | |
|---|---|---|---|
| 2,273,250 | 2/1942 | Charlton | 164/111 X |
| 2,358,090 | 9/1944 | Longoria | 164/80 X |

*Primary Examiner*—Robert D. Baldwin

*Attorney, Agent, or Firm*—Frishauf, Holtz, Goodman & Woodward

[57] ABSTRACT

A valve element is formed with a groove or notch in the region of the valve seat. The valve element is then introduced into a crucible pot which has the outer shape of the valve, when coated, and a cover is placed thereover completing the shape of the valve, when coated. Granular coating material, for example "Colmonoy 6" (0.75% C, 4.25% Si, 13 to 20% Cr. remainder Ni, 4.75% Fe and 3% B), is placed on the valve element, the cover is then placed thereover, leaving a small gap of the thickness of the coating around the valve element. The assembly is then subjected to vacuum, about $10^{-6}$–$10^{-7}$ torr, and heated to liquefaction temperature of the armor-coating material, which will fill the space between the valve element and the crucible pot and cover, thus coating the valve element with a thin coating therearound, and a thick layer in the region of the groove of the valve element, which may be in the order of millimeters, whereas the remainder may be in the order of thousandths of a millimeter.

6 Claims, 2 Drawing Figures

METHOD OF ARMO-COATING VALVE SEATS OF INTERNAL COMBUSTION ENGINES

Figures 1, 2:
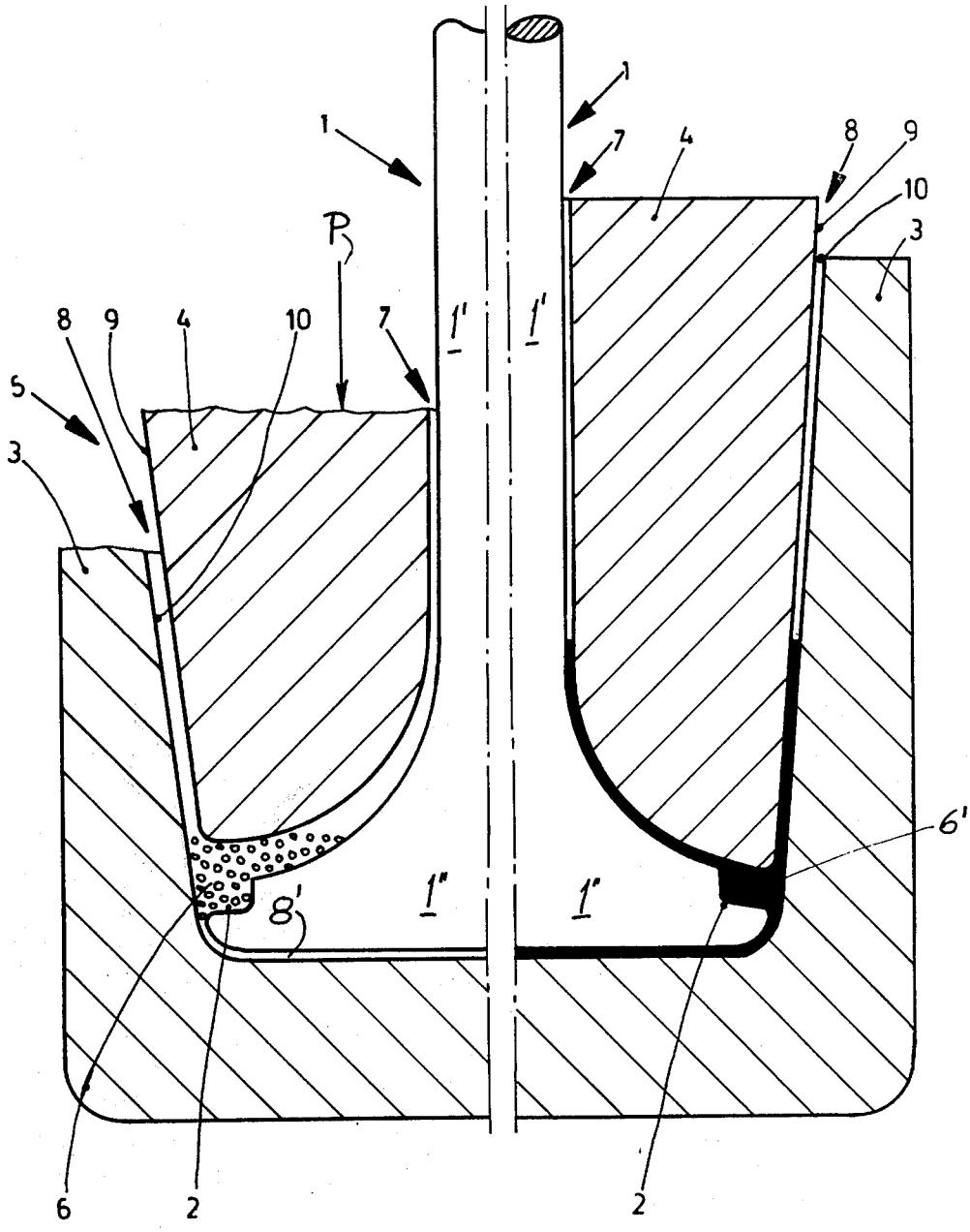

The present invention relates to a method to armor-coat the surfaces of valves and valve seats used in internal combustion engines and to the resulting articles, by using an armoring material which is resistant against corrosion under high-temperature conditions and is originally applied to the valve element in liquid form, and the resulting valve element.

BACKGROUND AND PRIOR ART

It has previously been proposed to coat valves, and specifically valve elements, which are used to control gas flow in internal combustion engines by dipping a valve element into a melt of a material which is resistant to corrosion under high-temperature conditions (see German Patent DE-PS No. 944,642).

This process has the disadvantage that, after dipping the valve element into the melt, a comparatively long time is required for the heat diffusion treatment so that the coating material will adhere properly to the valve element. Additionally, the thickness of the coating thus obtained is essentially uniform throughout the treated area.

Valves which are highly stressed in use require differential thicknesses of armor-coating material, so that in those regions where they are most subject to wear, they are more thickly coated. Thus, in the region of the valve seat, the valves should have a coating thickness of from between 2 to 3 mm; the remainder of the valve element may, however, have a coating thickness in the order of several $\mu$ m. Such a thin coating may be entirely sufficient for the remainder of the valve element.

Coating materials which, for example, are nickel-base materials can also be applied in form of an armor-coating layer by Plasmarc or Argonarc methods; such coating materials will have high wear resistance and will be extremely hard even at elevated temperatures of over 773 K (500° C.).

As the sizes of valves increase, difficulties arise with Plasmarc or Argonarc coating methods since the high temperatures with which the armor-coating material must be applied impinge the liquid coating material on a colder valve element, which leads to high internal stresses in the resulting coating. These internal stresses, due to the difference in temperature between the coating material in liquid phase and the colder valve element cannot be entirely removed by annealing, even heating to incandescence, to eliminate internal stresses, due to the high heat expansion limits and differences in temperature characteristics of the materials used for the valve element and the coating itself. Thus, upon additional stresses in use, or in further machining or manufacture, the armor-coating may be subjected to fissures, cracks, or other imperfections. The application process is somewhat similar to a welding process; using this application process in a semi-automatic application apparatus cannot exclude faults in the application or welding zones. Non-destructive quality control, even if very meticulous and careful, cannot detect defects within the coating, and thus defectively coated valve elements can be built into engines and used therein. In use, coating material may then break off, or be removed locally or entirely from the valve with consequential damage to the engine with which the valve element is used.

THE INVENTION

It is an object to provide a method, and a coated valve element which can be easily armor-coated, a method which can be carried out readily under mass production factory conditions in essentially automatically controlled sequences, and in which a valve can be coated with differential thickness at selected areas, while reliably excluding defects in the coating.

Briefly, the region or zone of a valve which forms the valve seat has a circumferential groove or notch formed therein. The thus machined valve element is then placed into a melting crucible which has inner contours or inner shapes corresponding to the outer shape of the valve element, after coating. The coating material itself is introduced into the crucible in granular form, filling at least the space of the groove or notch formed in the valve element, and preferably filling a larger zone thereof. The crucible has two elements—a melting or crucible pot element and a cover which fits around the valve element therein, the cover being freely movable in axial direction. The crucible is then heated, while a vacuum is applied, so that the granular armor material will liquefy and, under gravity, and the weight of the cover to the crucible which then will bear on the liquid coating material, will be forced in the space between the valve and the crucible, acting as a casting mold for the cover material around the valve element. The melting armor-coating material may, under some conditions, rise between the crucible pot portion and the cover, thus providing an entirely encapsulating, surrounding coating for the valve element after cooling.

A suitable armor-coating material is known under the commercial name of "Colmonoy 6", which comprises about 0.75% C, 4.25% Si, 13 to 20% Cr, remainder nickel 4.75% Fe, and 3% B.

The apparatus which is used is merely a crucible having the shape of the final valve element, as coated, on the inside and a cover therefor. Preferably, the pot portion of the crucible has a conical inner surface and the cover portion a conical outer surface, so arranged that they will form a conical ring gap and define therebetween a chamber which conforms to the outer configuration of the valve element, when coated. The cover itself is formed with a central opening to permit passage of the valve shaft portion of the valve element therethrough. The cover itself can float on the melting armor-coating material, or, if more pressure is needed, a weight can be placed thereon or external pressure applied by other suitable means, for example by a compressed air ram or the like.

The method and apparatus permit the manufacture of valve elements free from internal stresses due to differences in temperature in application, and consequent defects and fault positions. Bubbles and voids due to gas inclusion are likewise avoided, and the coating thickness of the valve element can be easily predetermined by suitably positioning the valve element with respect to the inner surface of the crucible or, rather, the pot portion of the crucible structure, by suitable holder or positioning means well known in the industry.

Use of "Colmonoy 6"—above defined—is particularly suitable and preferred; other coating materials may be used in the method and apparatus, as desired. Use of "Colmonoy 6" ensures a high degree of hardness and wear resistance in the region of the valve seat even under high stress operating conditions, while the remaining surfaces of the valves are effectively protected against corrosion by hot gases under high temperature conditions.

Drawings, illustrating a preferred example of an apparatus to carry out the method, wherein:

FIG. 1 is a half-section of an apparatus which is shown filled, before heating; and FIG. 2 is a half-section of the apparatus, illustrated rotated 180° with respect to FIG. 1, upon heating of the armor-coating material to melting temperature.

A crucible 5 has a melting pot portion 3 and a cover portion 4. A valve element 1 is vertically located within the crucible 5. The valve 1 has a shaft 1' which passes through an opening formed in the cover portion 4 of the crucible. The valve 1 has a head portion 1" which is formed with a circumferential groove 2. The valve 1, of course, is circular in plan view. The groove 2 is located in the region of the valve seat. The cover portion 4 of the crucible has an outer conical surface 9 which matches an outwardly tapering or expanding inner surface 10 of the pot portion 3 of the crucible, leaving a gap 8 therebetween. The cover portion 4 and the melting pot portion 3 define a chamber, the inner contours of which have the shape of the outer configuration of the armor-coated valve. A weight, schematically represented by arrow P, can be applied to the cover portion 4 by applying a downwardly directed force thereto; if the cover portion 4 is of sufficient weight, external application of force may not be needed.

The coating material to armor-coat the valve seat and the remainder of the valve element is introduced into the space adjacent the groove 2 in the form of granular material; this armor-coating material preferably is a nickel-base material and, in a specifically preferred form, the previously defined "Colmonoy 6".

Method steps and operation: The valve element 1 is placed in the crucible melting pot 3, and positioned with respect to the bottom thereof by a suitable holder, not shown, and of any desired and standard construction. The granular armor-coating material is then introduced as shown at 6, FIG. 1. Thereafter, the top or cover 4 of the crucible is placed on the granular coating material.

The crucible is then placed in a vacuum chamber, in which a vacuum of from between $10^{-6}$ to $10^{-7}$ torr is created. The crucible is heated to a temperature at which the armor-coating material 6 will liquefy; for "Colmonoy 6", this temperature is about 1313° K. Upon liquefication of the granular armor-coating material, the cover portion 4 will drop down to reach the position shown in FIG. 2, the liquefied armor-coating material filling the gap between the valve element 1 and the portions of the crucible, that is, the head face of the valve element and rising in the ring-shaped gaps 7 and 8 between the cover 4 and the pot portion 3, and the valve stem 1', respectively. The pressure which will exist in the gaps 7, 8 due to the liquid armor-coated column, that is, due to the column of melt and capillary action, will effect complete filling of all voids and spaces between the valve element 1 and the adjacent regions of the crucible 5, that is, the sides of the valve element 1 as well as the end face thereof, as shown in FIG. 2. The thickness of the gap 7 and 8, as well as of the gap 8' between the bottom of the pot portion 3 of the crucible 5 and the end face of the valve element 1 can be in the range of thousands of mm, which is sufficient to protect the valve element 1 against corrosion upon contact with hot gases. The thickness of the particular coating can be readily determined and defined by positioning the valve element 1 with respect to the bottom of the pot portion 3 of the crucible 5 in a suitable manner, for example by arranging a holder on a platform or table on which the crucible is located and which accurately maintains the position of the valve element 1 with respect to the inner bottom wall of the crucible 5, as well as with respect to the inner side wall thereof.

The valve seat itself is formed in the region of the groove 2 and will be entirely filled with armor-coating material, thus provides the necessary thickness in the region of the valve seat; this thickness may be in the order of several millimeters.

Typical valves 1 made of a material of, for example, X 45 CrSi 9 and the armor-coating material combine during a holding period of from between about 15 to 30 minutes at uniform temperature into a ductile diffusion zone. After cooling, the cover 4 can be removed and with it the valve element. The entire portion of the valve disk which is exposed to corrosive hot gases is reliably coated with a corrosion and wear resistant armor-coating, and the valve seat is additionally reinforced with a substantially thicker region thereof; the armor-coating will have no remaining internal stresses.

The coating and armoring method can be carried out in a vacuum furnace which is automatically time-and-process-controlled to automatically locate and position valve elements 1, introduce and requisite filler material 6, place the cover portion 4 thereon, and then cycle through a complete evacuation-heating-heat maintenance-and cooling cycle without requiring further operator attention.

Various changes and modification may be made within the scope of the inventive concept.

I claim:

1. Method of armor-coating valve element for internal combustion engines, in which a corrosion-resistant armor-coating material is applied in liquid form to the surface of the valve element comprising the steps of forming a groove (2) in the valve element (1) in the region of the valve seat thereof;

providing a crucible having a pot element (3) and a cover element (4) and which has an interior shape which conforms to the outer shape of the valve element, when coated;

introducing the valve element (1) in the pot element (3); introducing armor-coating material in granular form in the space formed by the groove within the crucible;

positioning the cover element (4) of the crucible in freely movable in-out relation with respect to the pot element thereof;

heating the assembly of the crucible (3, 4; 5), the valve element (1) therein, and the granular armor-coating material (6), under vacuum, to liquefaction temperature of the armor-coating material, the armor-coating material, upon liquefaction, filling the space between the valve element and the interior surfaces of the crucible and rising in gaps formed between the cover element (4) and the pot element (3) and the valve element (1), respectively, and filling the groove (2) in the valve element.

2. Method according to claim 1, wherein the granular armor-coating material (6) has a composition of, approximately, by weight: 0.75% carbon; 4.25% silicon; 13–20% chromium 4.75% iron; 3% boron, remainder nickel.

3. Method according to claim 2, wherein the temperature, during the melting phase, is approximately 1313° K.

4. Method according to claim 1, wherein the vacuum is in the order of between $10^{-6}$ to $10^{-7}$ torr.

5. Method according to claim 1, wherein the step of introducing the valve element (1) in the pot element (3) of the crucible (5) includes the step of spacing the outer surface of the valve element from the inner surface of the crucible by a predetermined amount and securing the valve element in so-spaced relationship with respect to the crucible.

6. Method according to claim 5, wherein the granular armor-coating material (6) has a composition of, approximately, by weight: 0.75% carbon; 4.25% silicon; 13–20% chromium 4.75% iron; 3% boron; remainder nickel;

wherein the temperature, during the melting phase, is approximately 1313° K.;

and wherein the vacuum is in the order of between $10^{-6}$ to $10^{-7}$ torr.

* * * * *